US006256840B1

(12) United States Patent
Elliott

(10) Patent No.: US 6,256,840 B1
(45) Date of Patent: Jul. 10, 2001

(54) SWING TOWEL

(76) Inventor: Paul Elliott, 12 Cove Dr., Sound Beach, NY (US) 11789

( * ) Notice: Subject to any disclaimer, the term of this patent is extended or adjusted under 35 U.S.C. 154(b) by 0 days.

(21) Appl. No.: 09/370,616

(22) Filed: Aug. 7, 1999

(51) Int. Cl.[7] ..... A47K 10/02
(52) U.S. Cl. ..... 24/3.11; 24/343
(58) Field of Search ..... 24/343, 344, 346–349, 24/3.11, 3.12, 3.6; 224/666–672, 674, 675; D6/608; 15/208.1, 209.1, 210.1, 118, 105

(56) References Cited

U.S. PATENT DOCUMENTS

D. 363,404 * 10/1995 Cute .
D. 384,717 * 10/1997 Hodges .
D. 424,124 * 5/2000 Diaz .
D. 425,781 * 5/2000 Hopper .
977,716 * 12/1910 Dovo .
2,968,825 * 1/1961 Wetherby .
4,226,105 * 10/1980 Wehrman .
4,319,384 * 3/1982 Horne .
4,779,655 * 10/1988 Olson .
5,075,918 * 12/1991 Zeltner et al. .
5,147,703 * 9/1992 Provost et al. .
5,318,292 6/1994 De Marco .
5,444,890 * 8/1995 Higginson .
5,533,656 * 7/1996 Bonaldi .
5,553,345 9/1996 Bell .
5,564,166 10/1996 Roy .
5,586,674 * 12/1996 Nachbauer .
5,671,515 9/1997 Evans .
5,799,853 * 9/1998 Brewster .
5,813,080 * 9/1998 Hendren .
5,893,190 * 4/1999 Mertz .
5,902,661 * 5/1999 Oster .

* cited by examiner

*Primary Examiner*—James R. Brittain
(74) *Attorney, Agent, or Firm*—Michael I. Kroll

(57) ABSTRACT

The present invention 10 discloses a clasped towel 10 wherein a towel 11 is attached to a clasp 13 which can be attached by means 30 to an article of clothing 12. A flap 38 is attached to the towel 11 which forms a partial pocket-like enclosure 39 on the towel in which items can be cleaned. An alligator clip-like element 32 is also shown for attaching the present invention 10 to the clothing 12.

4 Claims, 10 Drawing Sheets

SWING TOWEL

BACKGROUND OF THE INVENTION

1. Field of the Invention

The present invention relates generally to sports accessories, and, more specifically, to a device for facilitating the ready use of a towel to insure that the towel can easily be employed in a usable position. The towel and towel clip on device are designed to be attached to a belt loop or waistband of the wearer. Towels and other absorbent materials are used by tradesmen, such as, painters, bartenders, waitresses, and roofers, to name a few. Towels and other absorbent materials are used by sporting event participants in a variety of services. Towels are used to wipe face and hands, clean soiled equipment such as golf balls, golf clubs, tennis racket handles, and tools.

Golf towels are carried in pockets, golf carts, or stored in hard to get compartments on a golf bag. The non-attachable towel most likely will end up lost or bulging out of a pocket. This method of carrying a towel can become an inconvenient task. Trying to locate a misplaced towel can take the sportsmen's concentration away from the sport.

In the case of golf, when the towel is strapped or tucked into a golf bag, it requires the golfer to return to the bag to use the towel. The present invention removes the burden by employing a towel having means for attaching said towel to an article of clothing such as a belt loop or waist band. This method of attachment ensures the availability of the towel is easily attached and easily released. In addition the towel can be machine washed having means for disengaging the clip from the towel.

2. Description of the Prior Art

There are other clasp and towel devices. Typical of these is U.S. Pat. No. 5,671,515 issued to Evans on Sep. 30, 1997.

Another patent was issued to Roy on Oct. 15, 1996 as U.S. Pat. No. 5,564,166. Yet another U.S. Pat. No. 5,553,345 was issued to Bell on Sep. 10, 1996 and still yet another was issued on Jun. 7, 1994 to DeMarco as U.S. Pat. No. 5,318,292.

U.S. Pat. No. 5,671,515

Inventor: Michael D. Evans

Issued: Sep. 30, 1997

A clasp (10) for connecting two items includes two interconnecting members (11, 12). One member (1) utilizes a rivet (14) to engage one of the items, for example, a golf towel (23). That member (11) also has a receiver (24) formed therein which has a slot (25). The other member (12) has a tab (28) with a flexible button (30) extending upwardly therefrom. The tab (28) is received in the slot (25) until the button (30) snaps up through an aperture (21) in the cover (18) of the receiver (24). The members (11, 12) are thus attached to each other but the attachment can be disengaged merely by depressing the button (30) and sliding the tab (28) out of the slot (25). The other end of the member (12) has a foldable flap (26) which can be formed into a loop (40) to engage another item, for example, a portion (39) of a golf bag.

U.S. Pat. No. 5,564,166

Inventor: Armand E. Roy

Issued: Oct. 15, 1996

A badge clip secures a badge to be worn or carried by a person. The badge clip includes a fixed leg having a first end portion and an opposite second end portion with a curved barrel formation, and a movable leg having a first end portion with a curled barrel formation, and a movable leg having a first end portion which is reversely bent from the first end portion of the fixed leg, and an opposite second end portion which is engageable with the curled barrel formation of the fixed leg. The movable leg is pivotally movable between an open position and a closed position, the movable leg being biased to its closed position. The arrangement is such that the curled barrel formation of the fixed leg is capable of receiving a badge having an opening formed therein for securing the badge to the badge clip. The curled barrel formation is received through the opening of the badge when the movable leg is in its open position. The badge is secured to the badge clip when the movable leg resiliently returns to its closed position.

U.S. Pat. No. 5,553,345

Inventor: Steven Bell

Issued: Sep. 10, 1996

A clip-on towel is disclosed for use in sports and other activities where a readily accessible towel is advantageous. A first embodiment of the clip-on towel includes a clip portion that fits through an aperture in a towel portion and is adapted to engage the waistband of a user. The clip portion is attached to the towel by way of a restricted aperture thus eliminating the need for employing fasteners to attach the clip to the towel. A second embodiment includes a clip that is sewn to the towel and features a break away linger portion. If excessive force is applied to the clip, the towel breaks away from the user. The clip can be reassembled after breaking away inasmuch as it is designed to non-destructively separate.

U.S. Pat. No. 5,318,292

Inventor: Nicholas A DeMarco

Issued: Jun. 7, 1994

A springingly urged clasp is especially useful with a small towel such as the type used in golfing service and is a palm sized clasp which is both easily manually engageable and easily manually manipulable. The clamp, and its affixed towel, can be affixed to the golf bag, or any portion of the clothing to yield maximum easy utilization of the towel. In one embodiment, a golf towels reinforcing ring is fed into a slot on one side of the clamp of the present invention and onto a post to ensure secure, but interchangeable engagement.

While these golfing accessories may be suitable for the purposes for which they were designed, they would not be as suitable for the purposes of the present invention, as hereinafter described.

SUMMARY OF THE PRESENT INVENTION

The present invention discloses a clasped towel wherein a towel is attached to a clasp which can be attached by means to an article of clothing. A flap is attached to the towel which forms a partial pocket-like enclosure on the towel in which items can be cleaned. An alligator clip-like element is also shown for attaching the present invention to the clothing.

A primary object of the present invention is to provide a towel device which can be carried around by tradesmen in the performance of their tasks as well as sportsmen.

Another object of the present invention is to provide a towel device which can be attached to an article of clothing.

Yet another object of the present invention is to provide a towel device having an eyelet.

Still yet another object of the present invention is to provide a towel device having a clasp having means for attaching a towel with an eyelet thereto.

Yet another object of the present invention is to provide a towel device having a clasp having means for attaching a towel with an eyelet and having means for selectively attaching said clasp and towel to an article of clothing.

Additional objects of the present invention will appear as the description proceeds.

The present invention overcomes the shortcomings of the prior art by providing a device for facilitating the ready use of a towel to insure that the towel can easily be employed in a usable position. The towel and towel clip on device are designed to be attached to a belt loop or waistband of the wearer. In addition the towel can be machine washed having means for disengaging the clip from the towel.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
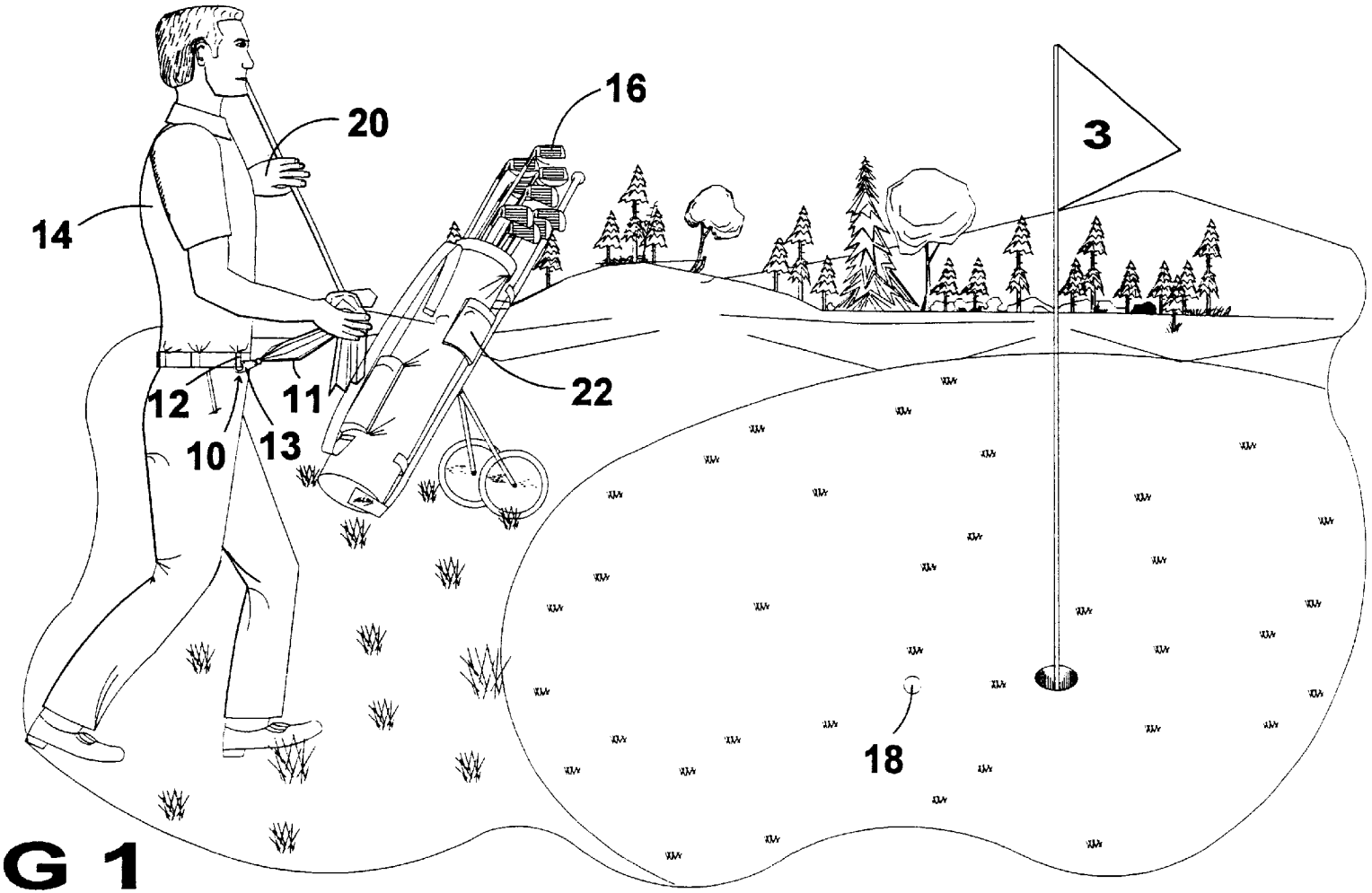
FIG. 1 is an illustrative view of one example of the use of the present invention. Shown is a golfer having the clasp towel attached to an article of clothing within easy reach whereby a golfer can clean golf equipment, such as clubs and balls, as well as, hands without having to return to the golf cart. The clasped towel is small enough and light enough so as not to interfere with the players game.

With regard to reference numerals used, the following numbering is used throughout the drawings.

10 present invention or clasped towel
11 towel
12 clothing article
13 clasp
14 golfer
16 golf club
18 golf ball

20 hand
22 golf cart
24 eyelet
26 looped wire member
28 means for attaching looped wire
30 means for attaching
31 pin
32 means for attaching
34 waist band
36 means for attaching
38 flap
39 partial enclosure
40 attachment on one side
42 club cloth
44 towel body
46 two edges
48 clamp member
50 clamp member
52 spring

DESCRIPTION OF THE PREFERRED EMBODIMENT(S)

In order that the invention may be more fully understood, it will now be described, by way of example, with reference to the accompanying drawings in which FIGS. 1 through 10 illustrate the present invention being a device for attachment of a towel to an article of clothing.

Turning to FIG. 1, shown therein is an illustrative view of one example of the use of the present invention 10. Shown is a golfer having the clasped towel 10 with towel 11 attached to an article of clothing 12 within easy reach whereby a golfer 14 can clean golf equipment, such as clubs 16 and balls 18, as well as, hands 20 without having to return to the golf cart 22. The clasped towel 10 is small enough and light enough so as not to interfere with the players game.

Figure 2:
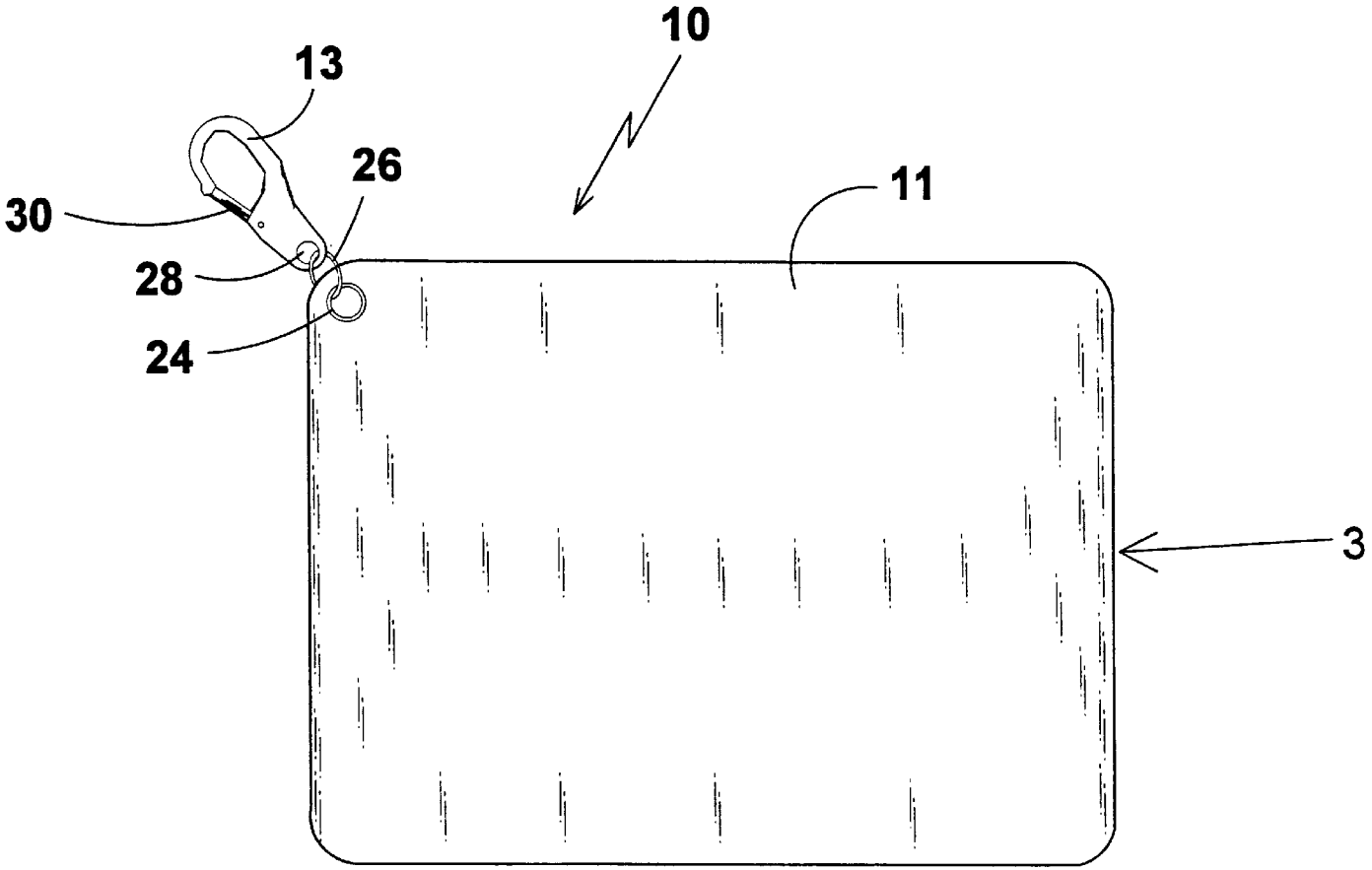
FIG. 2 is a front view of the present invention. Shown is a towel having an eyelet therein providing means for attaching a looped wire member thereto. Also shown is a clasp having means for attaching said looped wire member and towel thereto. Further said clasp having means for attaching said clasp, wire member and towel to an article of clothing.

Turning to FIG. 2, shown therein is a front view of the present invention 10. Shown is a towel 11 having an eyelet 24 therein providing means for attaching a looped wire member 26 thereto. Also shown is a hook-like clasp 13 having means 28, e.g., an aperture, for attaching said looped wire member 26 and towel 11 thereto. Further the clasp 13 has means for attaching 30 the clasp 13, wire member 26 and towel 11 to an article of clothing 12.

Figure 3:
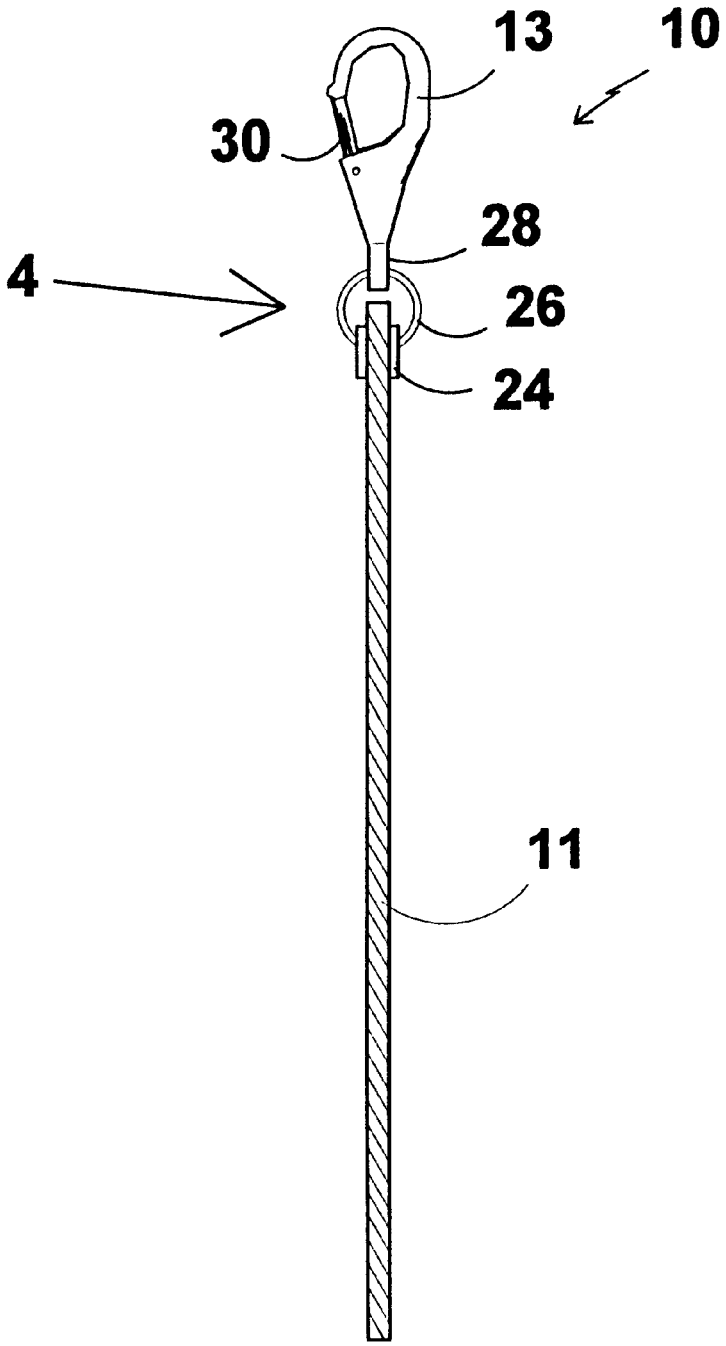
FIG. 3 is a side view of the present invention, taken from FIG. 2 as indicated. Shown is a towel having an eyelet therein providing means for attaching a looped wire member thereto. Also shown is a clasp having means for attaching said looped wire member and towel thereto. Further said clasp having means for attaching said clasp, wire member and towel to an article of clothing.

Turning to FIG. 3, shown therein is a side view of the present invention 10, taken from FIG. 2 as indicated. Shown is a towel 11 having an eyelet 24 therein providing means for attaching a looped wire member 26 thereto. Also shown is a clasp 13 having means for attaching 28 the looped wire member 26 and towel 11 thereto. Further the clasp 13 has means for attaching 30 the clasp 13, wire member 26 and towel 11 to an article of clothing 12.

Figure 4:
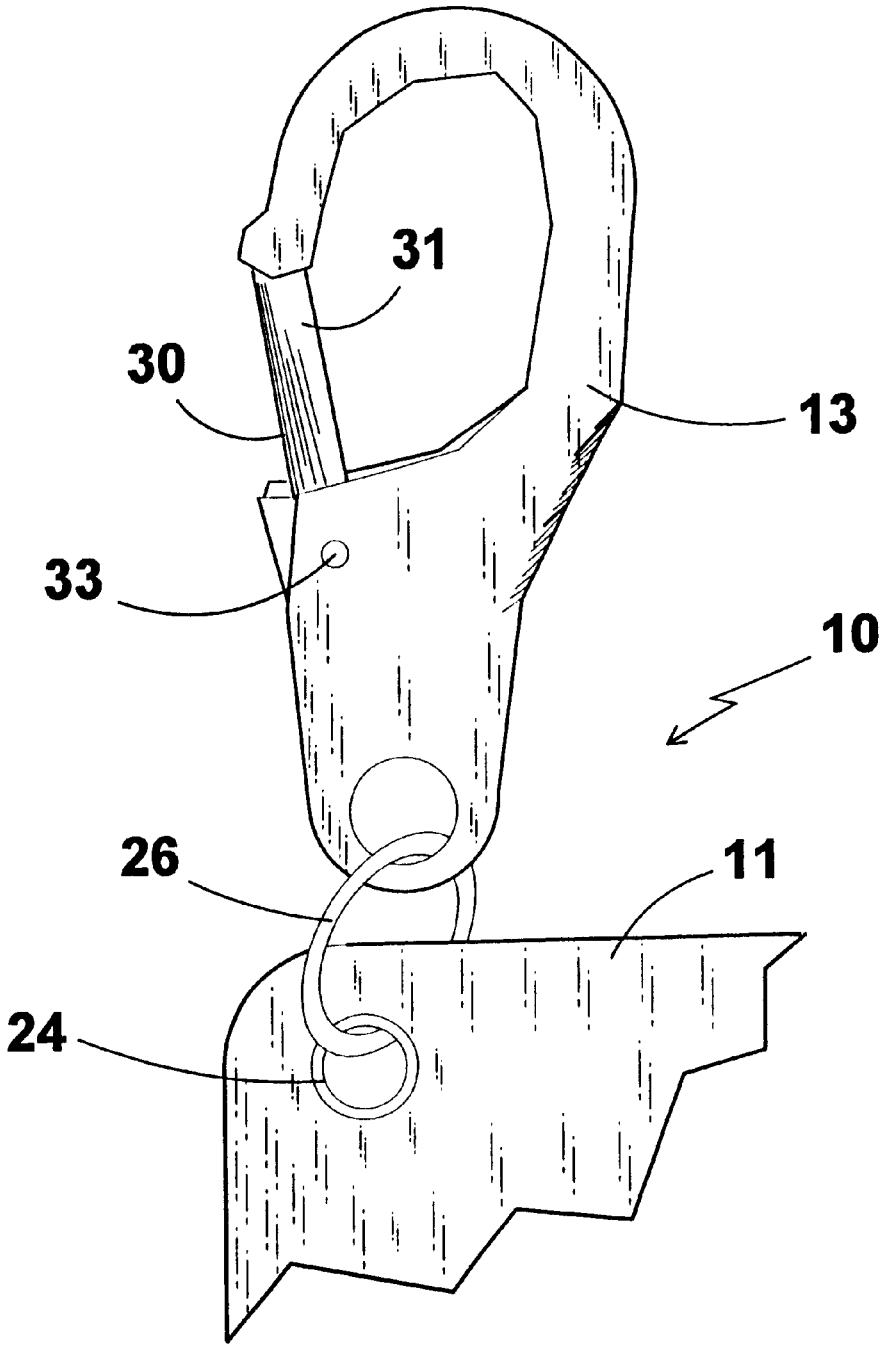
FIG. 4 is an enlarged sectional view of the present invention, taken from FIG. 3 as indicated. Shown is a clasp having means for selective attachment to an article of clothing. A wire member providing means for attaching one or more towels to said clasp. Also shown is a portion of a towel having an eyelet attached therein providing means for attachment to the looped wire member.

Turning to FIG. 4, shown therein is an enlarged sectional view of the present invention 10, taken from FIG. 3 as indicated. Shown is a clasp 13 having means for selective attachment 30 to an article of clothing 12. Means 30 has a pin 31 moving about a pivot 33. Pin 31 may be secured in the locked position by a friction lock or may be spring loaded. A wire member 26 provides means for attaching one or more towels 11 to said clasp 13. Also shown is a portion of a towel 11 having an eyelet 24 attached therein providing means for attachment to the looped wire member 26.

Figure 5:
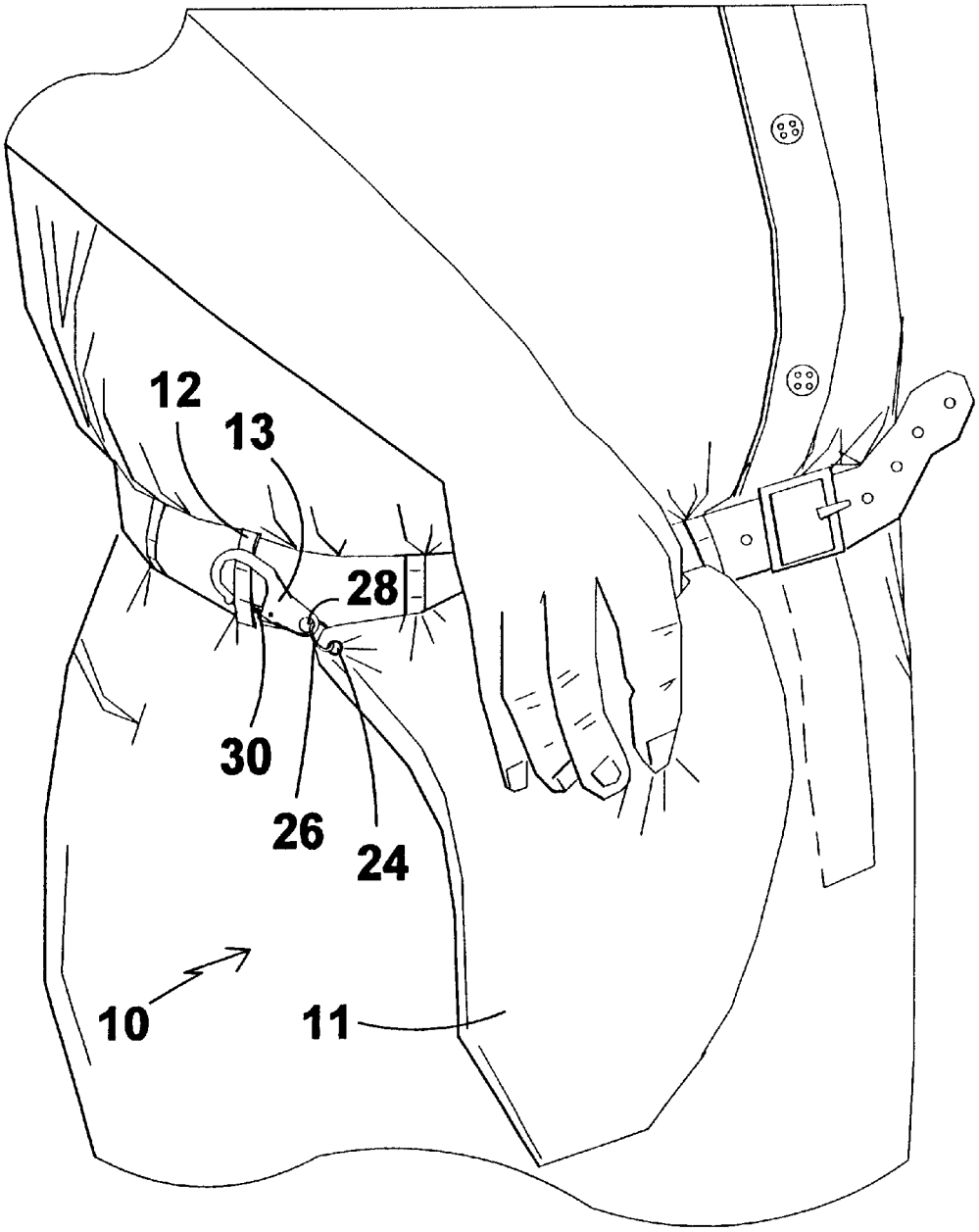
FIG. 5 is a perspective view of the present invention showing one means of attaching the present invention to an article of clothing. Shown is the present invention selectively attached to an article of clothing, a belt loop. Shown is a towel having an eyelet therein providing means for attaching a looped wire member thereto. Also shown is a clasp having means for attaching said looped wire member and towel thereto. Further said clasp having means for selectively attaching the clasp, wire member and towel to an article of clothing.

Turning to FIG. 5, shown therein is a perspective view of the present invention 10 showing one means of attaching the present invention 10 to an article of clothing 12. Shown is the present invention 10 selectively attached to an article of clothing, a belt loop 12. Shown is a towel 11 having an eyelet 24 therein providing means for attaching a looped wire member 26 thereto. Also shown is a clasp 13 having means for attaching 28 the looped wire member 26 and towel 11 thereto. Further, the clasp 13 has means for selectively attaching 30 the clasp 13, wire member 26 and towel 11 to an article of clothing 12.

Figure 6:
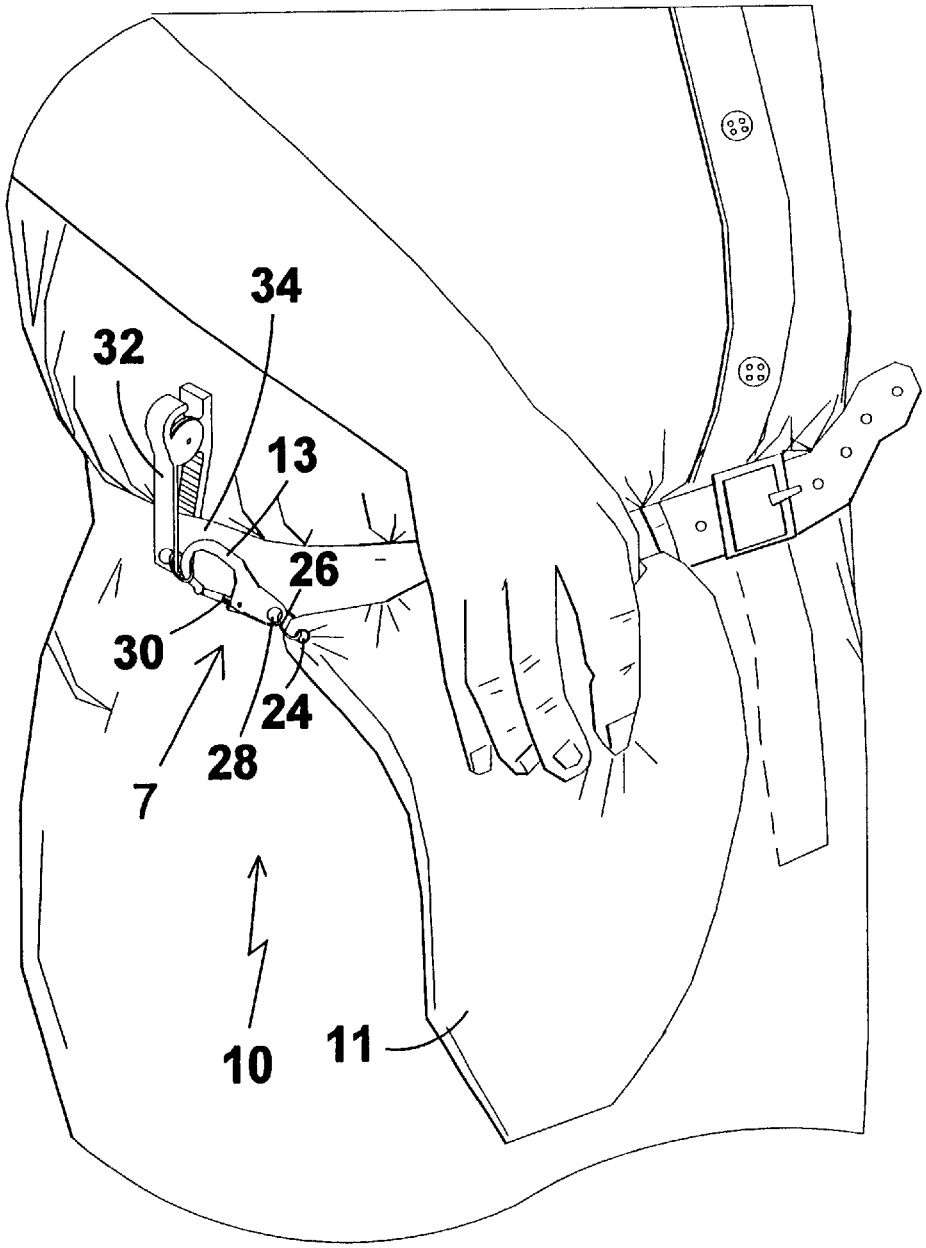
FIG. 6 is a perspective view of the present invention showing one means of attaching the present invention to an article of clothing. Shown is the present invention selectively attached to an article of clothing, a waistband. Shown is a towel having an eyelet therein providing means for attaching a looped wire member thereto. Also shown is a clasp having means for attaching said looped wire member and towel thereto. Further said clasp having means for selectively attaching the clasp, wire member and towel to an alligator-like clip having means for selective attachment to an article of clothing, such as a waistband.

Turning to FIG. 6, shown therein is a perspective view of the present invention 10 showing one means of attaching 32 the present invention to an article of clothing 12. Shown is the present invention 10 selectively attached to an article of clothing, a waistband 34. Shown is a towel 11 having an eyelet 24 therein providing means for attaching a looped wire member 26 thereto. Also shown is a clasp 13 having means for attaching 28 said looped wire member 26 and towel 11 thereto. Further the clasp 13 has means for selectively attaching 30 the clasp 13, wire member 26 and towel 11 to an alligator-like clip 32 providing means for selective attachment to an article of clothing, such as a waistband 34.

Figure 7:
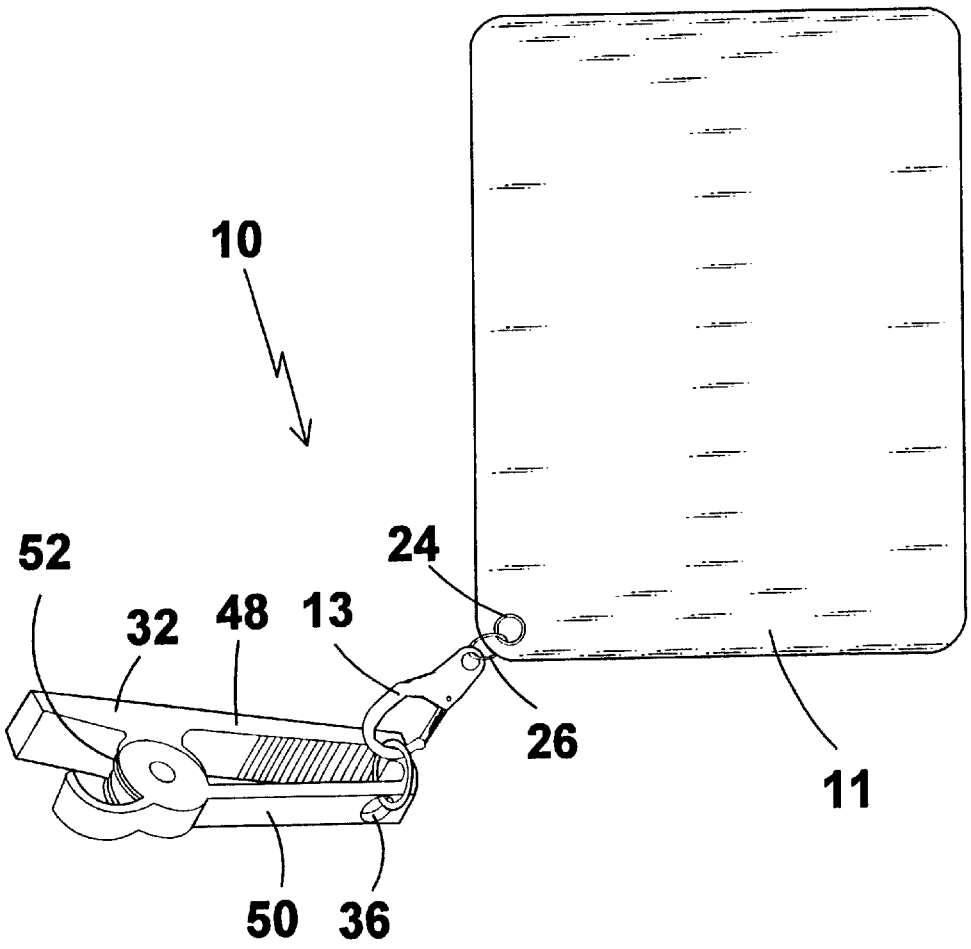
FIG. 7 is a front view of the present invention. Shown is an alligator-like clip having means for attaching said clip to an article of clothing. Further having means for attaching a clasp to said alligator clip. Said clasp having means for attaching a looped wire member. Said wire member providing means for attaching one or more towels to said clasp. Also shown is a the towel having an eyelet attached therein providing means for attachment to the looped wire member.

Turning to FIG. 7, shown therein is a front view of the present invention 10. Shown is an alligator-like clamp or clip 32 having means for attaching the clip 32 to an article of clothing 34. Alligator-like clip 32 has two opposing clamping members 48 and 50 which are biased to a clamping position by spring 52. Further having means for attaching 36, e.g., an aperture, a clasp 13 to the alligator clip 32. The clasp 13 has means for attaching a looped wire member 26. The wire member 26 providing means for attaching one or more towels 11 to the clasp 13. Also shown is the towel 11 having an eyelet 24 attached therein providing means for attachment to the looped wire member 26.

Figure 8:
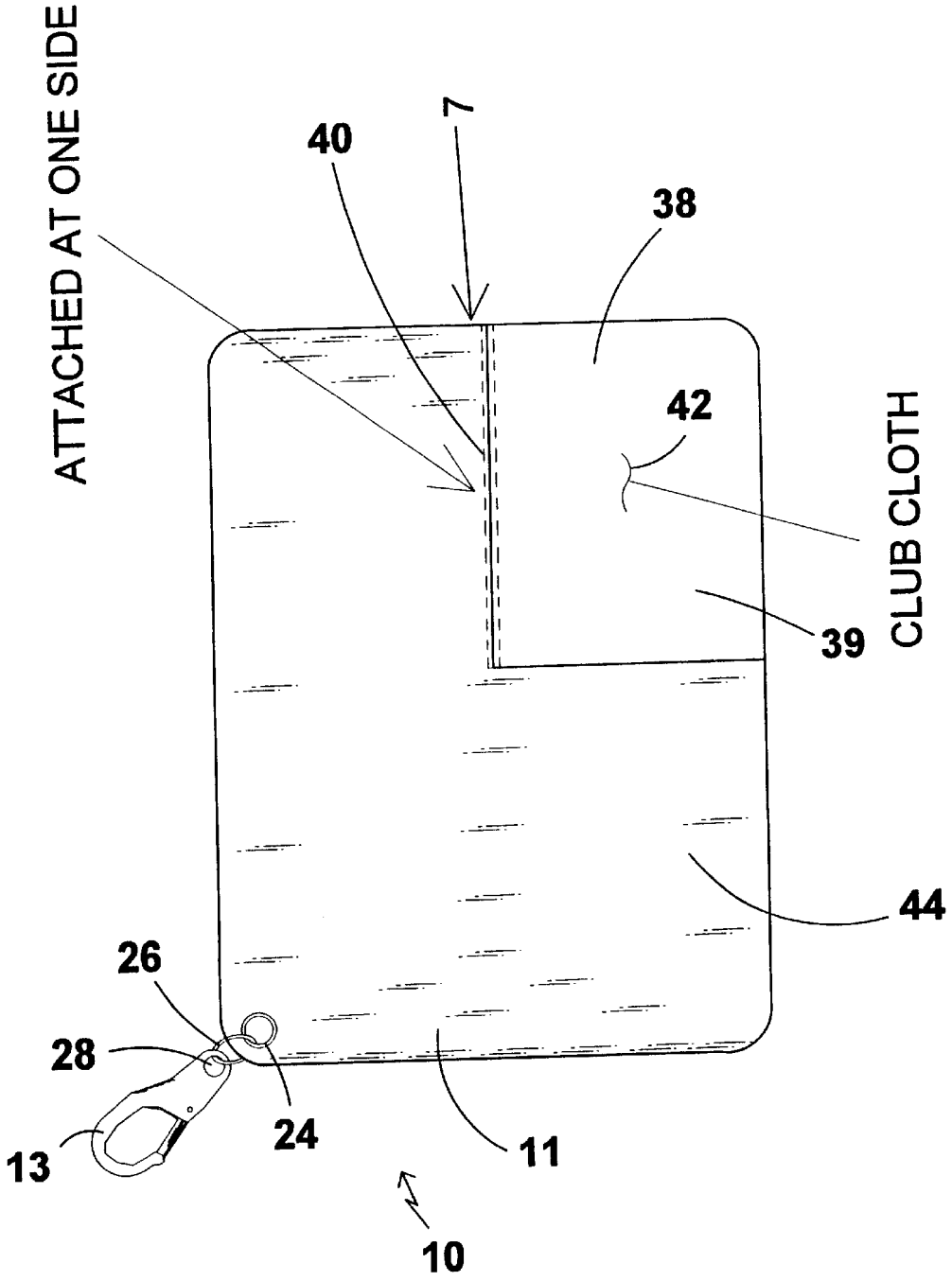
FIG. 8 is a front view of the present invention. Shown is a clasp having means for attaching a looped wire member thereto. Also shown is a towel having an eyelet providing means for attaching said towel to the looped wire member. Further the towel has a flap secured on one edge to the body of the towel forming an enclosed towel portion whereby the user can clean wet and muddy items within said enclosure formed by said flap without getting it on themselves.

Turning to FIG. 8, shown therein is a front view of the present invention 10. Shown is a clasp 13 having means, 28 for attaching a looped wire member 26 thereto. Also shown is a towel 11 having an eyelet 24 providing means for attaching the towel 11 to the looped wire member 26. Further the towel 11 has a flap 38 forming a club cloth 42 secured on one edge 40 to the main body 44 of the towel 11 forming a partially enclosed towel portion 39 whereby the user can clean wet and muddy items within the partial enclosure 39 formed by the flap 38 without getting it on themselves.

Figure 9:
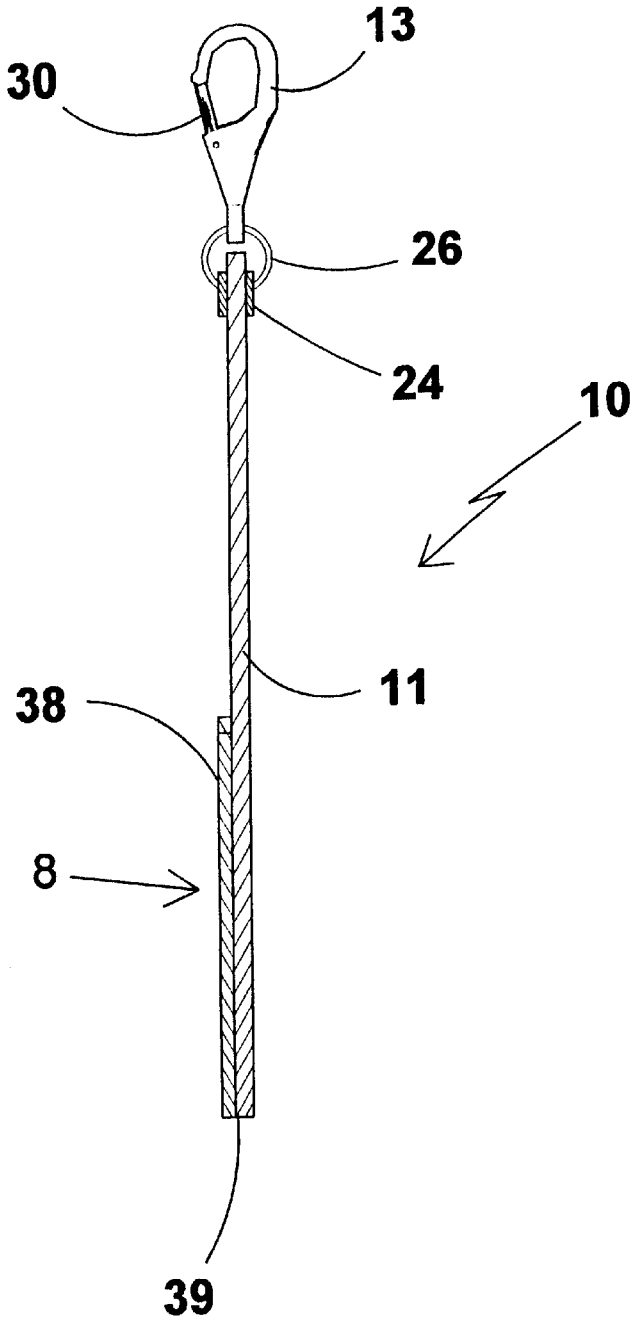
FIG. 9 is a side view of the present invention, taken from FIG. 8 as indicated. Shown is a towel having a flap and having an eyelet, having a looped wire member providing means for detaching said towel from the clasp whereby said towel can be replaced or washed, and having a clasp. Said wire member having means for attaching one or more towel having eyelets thereto and having means for selectively attaching said clasped towel to an article of clothing.

Turning to FIG. 9, shown therein is a side view of the present invention 10, taken from FIG. 8 as indicated. Shown is a towel 11 having a flap 38 and having an eyelet 24, having a looped wire member 26 providing means for detaching the towel 11 from the clasp 13 whereby the towel 11 can be replaced or washed, and having a clasp 13. The wire member 26 has means for attaching one or more towels having eyelets thereto and having means for selectively attaching 30 the clasped towel 10 to an article of clothing 12 (not shown). Partial enclosure 39 is also shown as previously disclosed.

Figure 10:
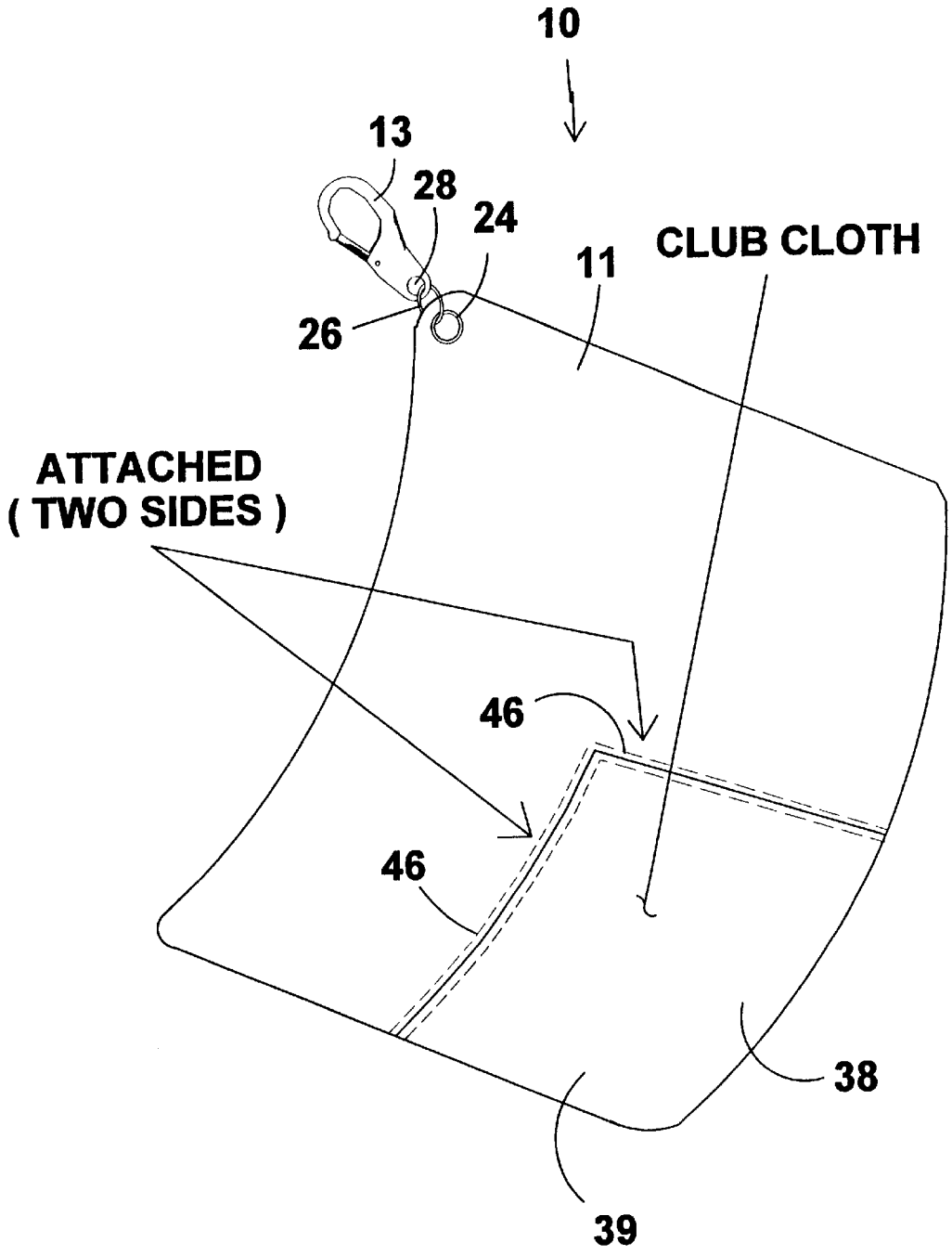
FIG. 10 is a front view of the present invention. Shown is a clasp having means for attaching a looped wire member thereto. Also shown is a towel having an eyelet providing means for attaching said towel to the looped wire member. Further the towel has a flap secured on two edges to the body of the towel forming an enclosed towel portion whereby the user can clean wet and muddy items within said enclosure formed by said flap without getting it on themselves.

Turning to FIG. 10, shown therein is a front view of the present invention 10. Shown is a clasp 13 having means for attaching 28 a looped wire member 26 thereto. Also shown is a towel 11 having an eyelet 24 providing means for attaching the towel 11 to the looped wire member 26. Further the towel 11 has a flap 38 secured on two edges 46 to the body of the towel 11 forming a partially enclosed towel portion 39 whereby the user can clean wet and muddy items within the enclosure 39 formed by the flap 38 without getting it on themselves.

What is claimed to be new and desired to be protected by Letters Patent is set forth in the appended claims:

1. An apparatus for and in combination with a towel, comprising:

a) a clasp;

b) a first means for attaching said clasp to an article of clothing;

c) an eyelet provided in the towel;

d) said clasp having a second means for attaching the towel thereto;

e) a third means for attaching the towel to said clasp by passing through said eyelet and attaching to said second means for attaching the towel;

f) said first means comprising an alligator clip having two opposing clamping members pivotally connected together at one end of each clamping member with a spring biasing opposite ends of said clamping members

2. The apparatus of claim 1, wherein the towel further comprises a flap attached to the towel.

3. The apparatus of claim 2, wherein said flap is sewn to the towel on no more than one side of said flap.

4. The apparatus of claim 2, wherein said flap is sewn to the towel on two sides of said flap.

* * * * *